US007731182B2

(12) United States Patent
Nishii et al.

(10) Patent No.: US 7,731,182 B2
(45) Date of Patent: Jun. 8, 2010

(54) SLIDING MECHANISM, SHEET GUIDE, SHEET LOADING DEVICE, AND IMAGE FORMING APPARATUS

(75) Inventors: Toshikane Nishii, Osaka (JP); Hiroshi Fujiwara, Osaka (JP); Shigeo Nanno, Kyoto (JP); Tomoyoshi Yamazaki, Tokyo (JP); Yasuhide Ohkubo, Osaka (JP); Ippei Kimura, Osaka (JP); Masafumi Takahira, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 11/987,046

(22) Filed: Nov. 27, 2007

(65) Prior Publication Data

US 2008/0143046 A1 Jun. 19, 2008

(30) Foreign Application Priority Data

Dec. 7, 2006 (JP) ..... 2006-330552

(51) Int. Cl.
*B65H 1/00* (2006.01)

(52) U.S. Cl. ..... 271/171

(58) Field of Classification Search ..... 271/171, 271/145

See application file for complete search history.

(56) References Cited

U.S. PATENT DOCUMENTS

| | | | | |
|---|---|---|---|---|
| 5,219,154 | A | 6/1993 | Fukube et al. | |
| 5,316,282 | A | 5/1994 | Fukube et al. | |
| 5,322,269 | A | 6/1994 | Fukube et al. | |
| 5,332,209 | A * | 7/1994 | Romansky et al. | 271/171 |
| 5,405,128 | A | 4/1995 | Fujiwara et al. | |
| 6,116,591 | A * | 9/2000 | Kim | 271/171 |
| 6,916,019 | B2 * | 7/2005 | Takahashi | 271/145 |
| 6,926,269 | B2 * | 8/2005 | Ishikuro | 271/171 |
| 7,036,816 | B2 * | 5/2006 | Abe | 271/171 |
| 7,429,041 | B2 * | 9/2008 | Yokoi | 271/162 |
| 2003/0151188 | A1 * | 8/2003 | Imahara | 271/171 |
| 2005/0151315 | A1 * | 7/2005 | Yokoi | 271/145 |
| 2006/0113723 | A1 * | 6/2006 | Ito et al. | 271/162 |
| 2006/0222434 | A1 * | 10/2006 | Kitamura et al. | 400/624 |
| 2006/0290049 | A1 | 12/2006 | Fujiwara | |
| 2007/0065201 | A1 | 3/2007 | Fujiwara et al. | |
| 2007/0114713 | A1 * | 5/2007 | Yonemoto | 271/171 |
| 2007/0138737 | A1 * | 6/2007 | Yamada | 271/171 |
| 2007/0172255 | A1 | 7/2007 | Nanno et al. | |

FOREIGN PATENT DOCUMENTS

| | | | |
|---|---|---|---|
| JP | 04144840 | * | 5/1992 |
| JP | 09-071328 | | 3/1997 |
| JP | 2006-248744 | | 9/2006 |

* cited by examiner

*Primary Examiner*—Patrick Mackey
*Assistant Examiner*—Patrick Cicchino
(74) *Attorney, Agent, or Firm*—IPUSA, PLLC

(57) ABSTRACT

A sliding mechanism includes a sheet position limiting member having a sheet position limiting surface, the sheet position limiting member being configured to slide in a direction perpendicular to the plane of the sheet position limiting surface; and a guide member configured to guide the sliding of the sheet position limiting member.

12 Claims, 5 Drawing Sheets

(a)

(b)

SLIDING MECHANISM, SHEET GUIDE, SHEET LOADING DEVICE, AND IMAGE FORMING APPARATUS

BACKGROUND OF THE INVENTION

1. Field of the Invention

The present invention generally relates to sliding mechanisms, sheet guides, sheet loading devices, and image forming apparatuses.

More specifically, the present invention relates to a sliding mechanism configured to slide a member having a standard surface in a direction perpendicular to the standard surface, and a sheet guide, a sheet loading device, and an image forming apparatus using the sliding mechanism.

2. Description of the Related Art

In a conventional art image forming apparatus, it is necessary for a sheet feeding mechanism to correspond to various sizes of sheet cassettes, depending on the user's need. For this purpose, a side fence for adjusting to the sheet width of a sheet size is required. It is required that the side fence be movable. In most cases, the side fence is adjusted to the sheet width by a manual operation of the user.

Japanese Laid-Open Patent Application Publication No. 2006-248744 describes a sheet material storage vessel, a side register adjusting device and an image forming device that are conventional art examples with respect to a sheet feeding mechanism of an image forming apparatus having a movable type side fence.

With respect to an operational force necessary for moving the side fence, if sliding resistance in the moving direction is too weak, deviation of a printed image may occur due to instability at the time of the sheet conveyance. On the other hand, if the sliding resistance in the moving direction is too strong, the user cannot move the side fence. Accordingly, it is necessary to make the side fence have a proper sliding resistance.

However, in the sheet feeding mechanism of the conventional art image forming apparatus including the invention described in the Japanese Laid-Open Patent Application Publication No. 2006-248744, it is not considered to properly set the sliding resistance of the side fence.

Because of this, the side fence may be shifted at the time of the sheet conveyance so that the deviation of the printed image may occur or it may be difficult for the user to move the side fence.

SUMMARY OF THE INVENTION

Accordingly, embodiments of the present invention may provide a novel and useful sliding mechanism, sheet guide, sheet loading device, and image forming apparatus which solve one or more of the problems discussed above.

More specifically, the embodiments of the present invention may provide a sliding mechanism, a sheet guide, a sheet loading device, and an image forming apparatus whereby a slid member is not shifted in error and can be easily moved by an operation of a user.

One aspect of the present invention may be to provide a sliding mechanism, including a sheet position limiting member having a sheet position limiting surface, the sheet position limiting member being configured to slide in a direction perpendicular to the plane of the sheet position limiting surface; and a guide member configured to guide the sliding of the sheet position limiting member; wherein the sheet position limiting member includes a wall including a limiting surface; a bottom substantially parallel with a sheet; and a first rib provided at a surface of the bottom coming in contact with the guide member, the first rib being parallel to the sliding direction; wherein the guide member includes a second rib forming a pair with the first rib, the second rib being situated in a direction substantially parallel to the sliding direction of the sheet position limiting member, the second rib coming in contact with the first rib; and wherein the pair of the first rib and the second rib slide while coming in contact with each other.

Another aspect of the present invention may be to provide a sheet guide, including the sliding mechanism mentioned above, wherein two of the sheet position limiting members are provided at the guide member; and one of the sheet position limiting members interlocks with the other sheet position limiting member and a gap between the sheet position limiting members is variable.

Another aspect of the present invention may be to provide a sheet loading device, including a housing configured to receive sheets; and the sliding mechanism mentioned above.

Another aspect of the present invention may be to provide a sheet loading device including a housing configured to receive sheets; and the sheet guide mentioned above.

Another aspect of the present invention may be to provide a manual sheet feeding tray including the sliding mechanism mentioned above.

Another aspect of the present invention may be to provide a manual sheet feeding tray, including the sheet guide mentioned above.

Another aspect of the present invention may be to provide an image forming apparatus, including the sheet loading device mentioned above.

Other aspect of the present invention may be to provide an image forming apparatus, including the manual sheet feeding tray mentioned above.

According to the present invention, it is possible to provide a sliding mechanism, a sheet guide, a sheet loading device, a manual sheet feeding tray, and an image forming apparatus whereby a sliding member is not shifted in error and can be easily moved by an operation of a user.

Other objects, features, and advantages of the present invention will become more apparent from the following detailed description when read in conjunction with the accompanying drawings.

DETAILED DESCRIPTION OF THE PREFERRED EMBODIMENTS

A description is given below, with reference to the FIG. 1 through FIG. 5 of embodiments of the present invention.

Figure 1:
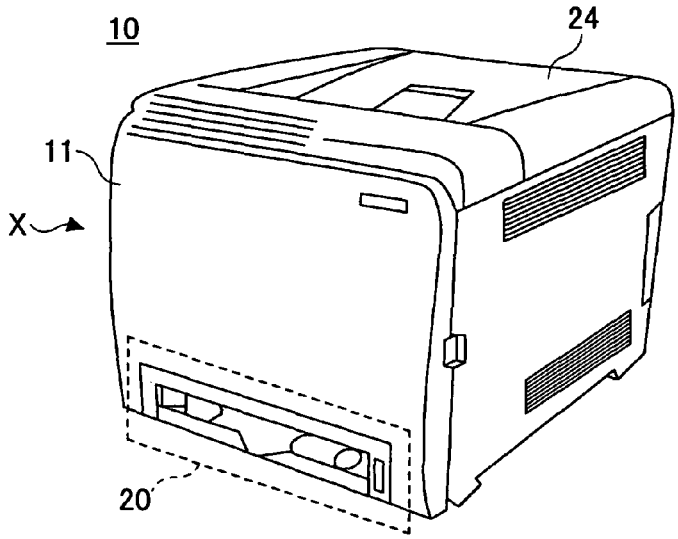
FIG. 1 has views showing a structure of a laser printer of an embodiment of the present invention.
Figure 1:
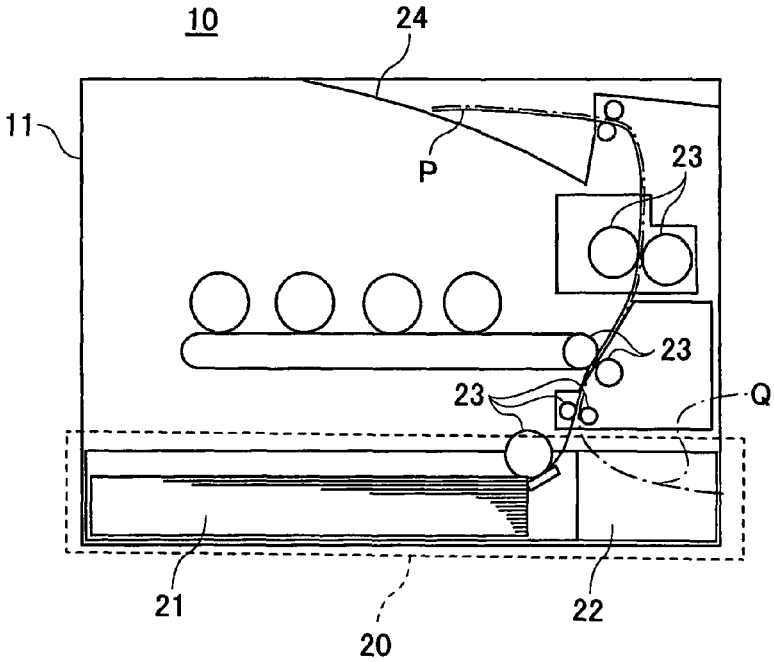

FIG. 1 has views showing a structure of a laser printer of an embodiment of the present invention. More specifically, FIG. 1(*a*) is a perspective view of a laser printer 10 of the embodiment of the present invention. FIG. 1(*b*) is a schematic vertical cross section seen in a direction indicated by an arrow X of the laser printer 10 in FIG. 1(*a*).

As shown in FIG. 1, a sheet feeding tray 20 is provided in a lower part of a printer main body 11 of the laser printer 10. The sheet feeding tray 20 includes a sheet feeding cassette 21, a manual sheet feeding part (manual tray) 22, and others.

At an upper part of the sheet feeding tray 20 inside the printer main body 11, a conveyance path of a sheet is provided. Plural conveyance rollers 23 are provided at the conveyance path. A sheet provided in the sheet feeding cassette 21 is conveyed to a sheet discharging part 24 as shown by a solid line P by driving the conveyance rollers 23. A sheet conveyed from the manual sheet feeding part (manual tray) 22 is conveyed to the sheet discharging part 24 as shown by a one-dotted line Q by driving the conveyance rollers 23.

Figure 2:
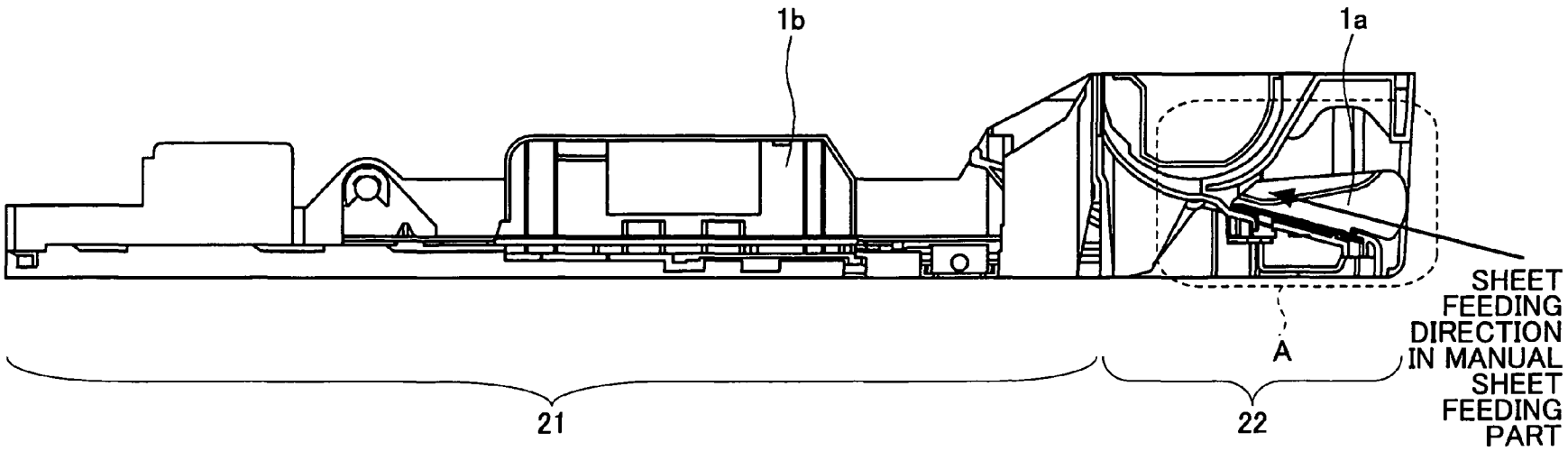
FIG. 2 is a first view showing structures of a sheet feeding cassette and a manual sheet feeding part of the embodiment of the present invention.

FIG. 2 is a first view showing structures of the sheet feeding cassette 21 and the manual sheet feeding part (manual tray) 22 shown in FIG. 1(*b*). In FIG. 2, an inclined arrow indicates a sheet feeding direction in the manual sheet feeding part (manual tray) 22.

Side fences 1*a* (corresponding to a sheet position limiting surface in the following claims) are used for a manual sheet feeding mechanism of the sheet feeding tray provided at the laser printer 10 front surface. Side fences 1*b* are used for a sheet feeding main body situated inside the sheet feeding cassette 21. The sheet feeding cassette 21 can receive (store) sheets.

Figure 3:
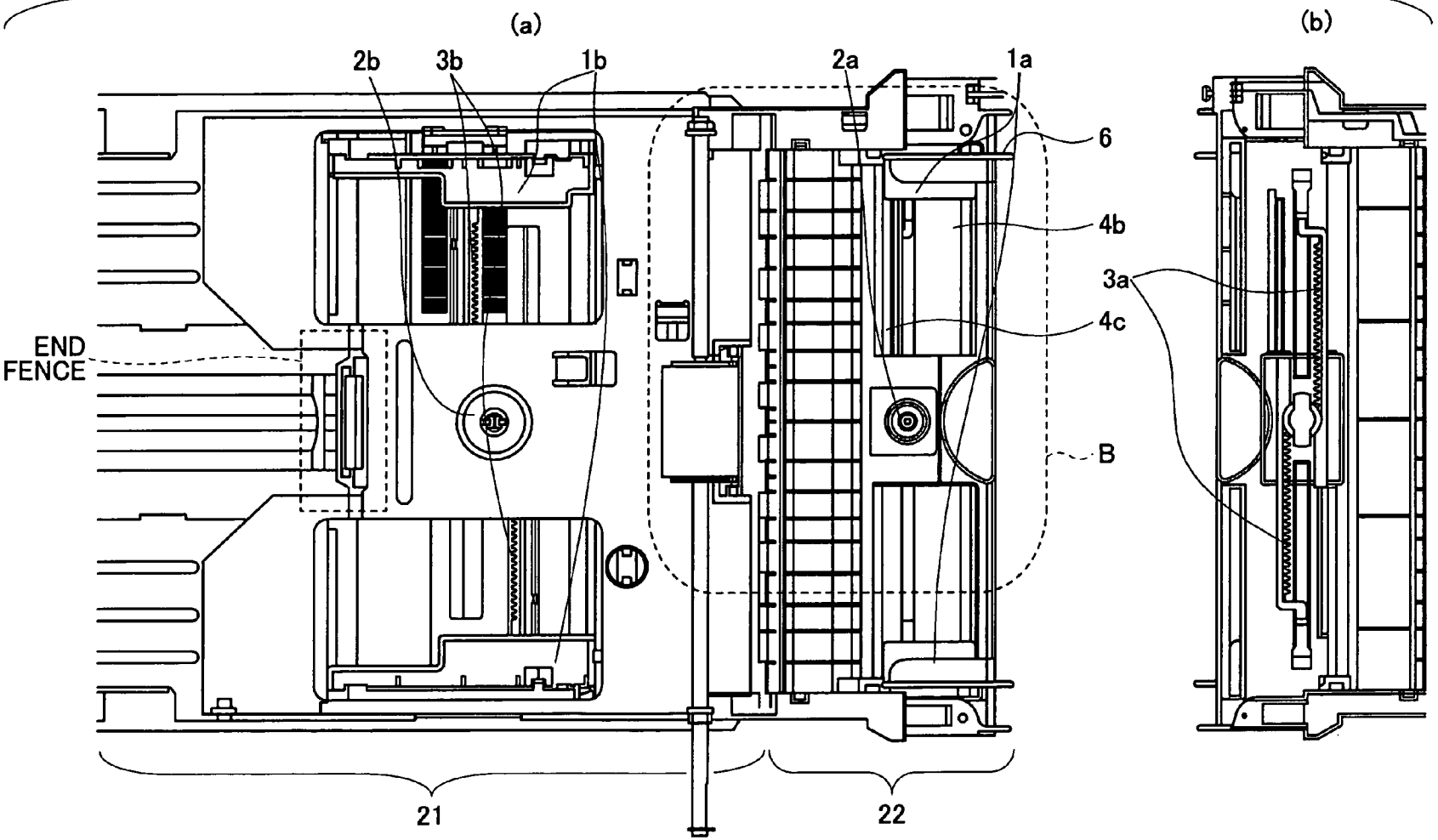
FIG. 3 is a second view showing the structures of the sheet feeding cassette and the manual sheet feeding part of the embodiment of the present invention.

FIG. 3 is a second view showing the structures of the sheet feeding cassette 21 and the manual sheet feeding part (manual tray) 22 of the embodiment of the present invention. More specifically, FIG. 3(*a*) shows top views of the sheet feeding cassette 21 and the manual sheet feeding part (manual tray) 22. FIG. 3(*b*) shows a bottom view of the manual sheet feeding part (manual tray) 22.

A pinion 2*a* meshes with rack parts 3*a* that are provided one at each of a pair of the side fences 1*a*. In addition, a pinion 2*b* meshes with rack parts 3*b* that are provided at one at each of a pair of the side fences 1*b*.

Figure 4:
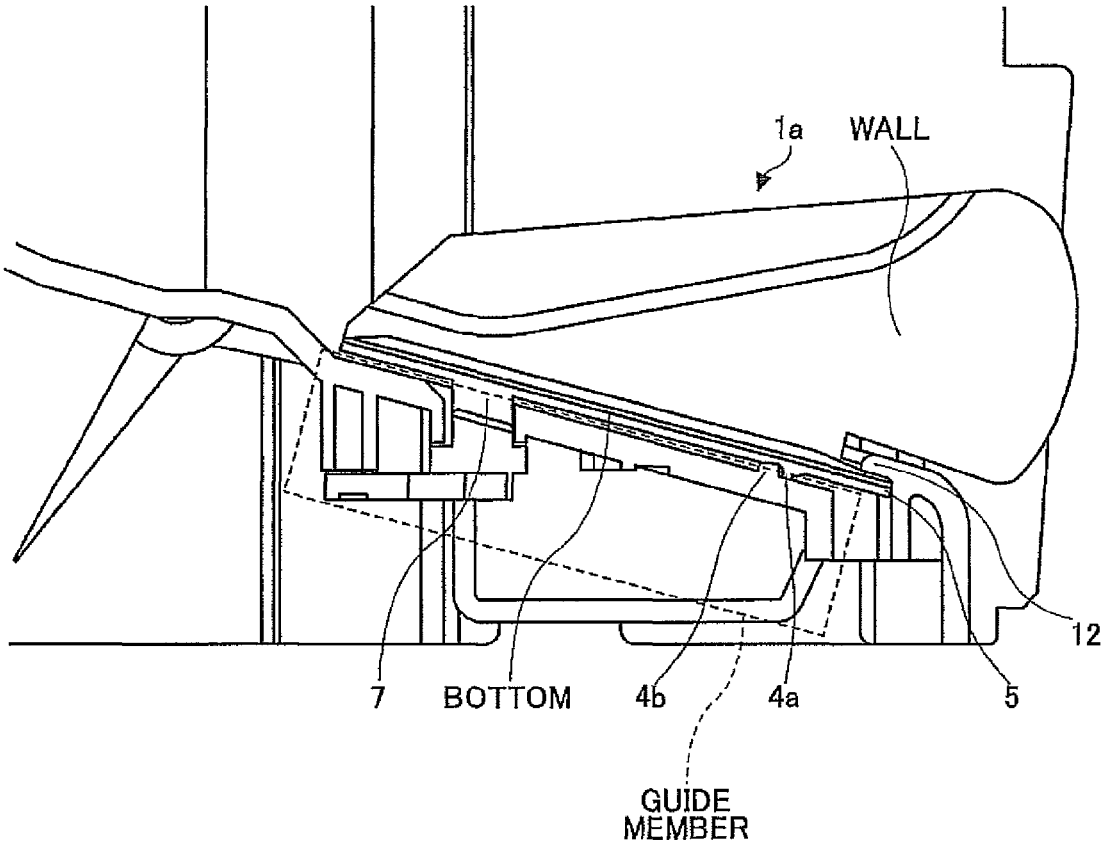
FIG. 4 is a view showing a structure of a side fence of the manual sheet feeding part.
Figure 5:
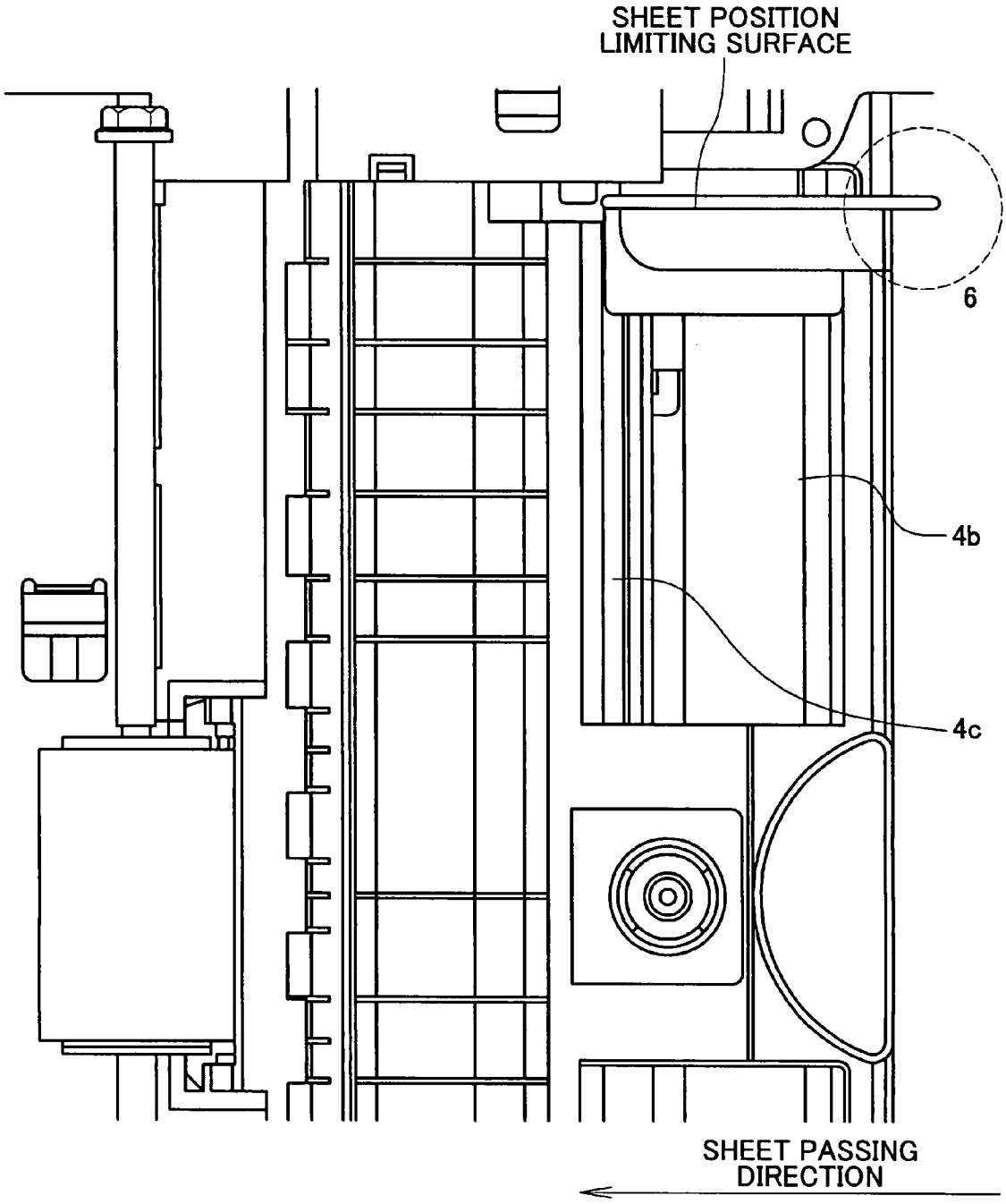
FIG. 5 is a view showing a structure of the manual sheet feeding part.

FIG. 4 is a partial cross section showing a structure of the manual sheet feeding part (manual tray) 22. More specifically, FIG. 4 is an enlarged view of a part surrounded by a dotted line A of FIG. 2. FIG. 5 is a view showing a structure of the manual sheet feeding part (manual tray) 22. More specifically, FIG. 5 is an enlarged view of a part surrounded by a dotted line B of FIG. 3.

A rib 4*a* (corresponding to a first rib in the following claims) and a rib 4*b* (corresponding to a second rib in the following claims) come in contact with each other in the sheet feeding direction and can slide against each other in a direction orthogonal to the sheet feeding direction. Because of the rib 4*a* and rib 4*b*, the side fences 1*a* can move without causing instability of the side fence 1*a*.

More specifically, if the rib 4*a* and the rib 4*b* are not provided, when an operational part 6 (see FIG. 5) of the side fence 1*a* is held and the side fences 1*a* are slid, a greater moment is generated with respect to a supporting part 7 (see FIG. 4). On the other hand, in a case where the rib 4*a* and the rib 4*b* are provided, when the operational part 6 is held and the side fences 1*a* are slid, a lesser moment is generated with respect to where the rib 4*a* and the rib 4*b* come in contact with each other.

Because of this, in a case where the rib 4*a* and the rib 4*b* are provided, it is possible to easily maintain the alignment of the side fences 1*a* parallel to the sheet conveyance direction and smoothly move the side fences 1*a* in directions perpendicular to the sheet conveyance direction. It is preferable to form the rib 4*a* so that the rib 4*a* is situated closer to the operational part 6 (see FIG. 5) than the rib 4*b* is.

An energizing part 5 (see FIG. 4) has an in-contact length (length that can be deformed by pressure contacting or energizing), namely a length in upper and lower directions where a part of the side fences 1*a* and a part of the manual tray 22 are in slidable contact with each other. As the in-contact length is greater, repulsion (spring force) due to elasticity is greater so that the vertical resistance (force) is increased and the sliding resistance is greater.

Therefore, the side fence 1*a* itself is bent and has sliding resistance. In other words, a rear end of the bottom surface of the side fence 1*a* is provided under a convex part 12 of the manual tray 22 so that the side fence 1*a* is curved where the rib 4*b* works as a fulcrum.

Because of this, at the energizing part 5, the rear end of the bottom surface of the side fence 1*a* is pushed toward its original plane by an elastic force and the rear end of the bottom surface of the side fence 1*a* and the convex part 12 of the sheet feeding tray are pushed toward each other.

By properly setting the in-contact length of the energizing part 5 (bending amount of the rear end of the side fence 1*a*), it is possible to provide sliding resistance that does not allow movement due to instability of a sheet but does allow the possibility of movement due to the operations of the user.

While only the rear end of the bottom surface of the side fence 1*a* is energized in this example, an in-contact length in the upper and lower directions may be provided at a front side of the rib 4*b*.

Referring to FIG. 5, the rib 4*b* and a rib 4*c* guide the side fences 1*a* (see FIG. 2). The rib 4*c* is situated near the position of the pinion 2*a* in the sheet feeding direction. In this case, since the rib 4*a* is close to the user operational part 6, by providing the additional sliding resistance due to the rib 4*c* situated near the pinion 2*a*, the side fences 1*a* can be easily moved due to the moment generated during the side fences 1*a* operations.

Depending on the layout, when the rib 4*c* is situated near the position of the pinion 2*a* in the sheet feeding direction, operations may be easily performed.

A sliding resistance giving member may be provided at the energizing part 5 so that sliding resistance is given to the side fences 1*a*. It is preferable to use a felt or fibrous material as the sliding resistance giving member. In addition, by providing the sliding resistance giving member with directional properties by using a slanted fiber, it is possible to provide a sliding resistance that is weak in a direction shortening the gap between the side fences 1*a* and strong in a direction widening the gap between the side fences 1*a*. Because of this, it is possible to prevent the generation of image deviation due to the instability of a sheet and thus improve the operational properties for the user. The sliding resistance giving member may be fixed to the side fences 1*a* or to bottom surface of the manual tray 22.

The sheet feeding cassette of the embodiment of the present invention can be applied to any image forming apparatus such as an electrophotographic type image forming apparatus or an ink jet type image forming apparatus.

According to one embodiment of the present invention, it is possible to provide a sliding mechanism, including a sheet position limiting member having a sheet position limiting surface, the sheet position limiting member being configured to slide in a direction perpendicular to the plane of the sheet position limiting surface; and a guide member configured to guide the sliding of the sheet position limiting member; wherein the sheet position limiting member includes a wall including a limiting surface; a bottom substantially parallel with a sheet; and a first rib provided at a surface of the bottom coming in contact with the guide member, the first rib being parallel to the sliding direction; wherein the guide member includes a second rib forming a pair with the first rib, the second rib being situated in a direction substantially parallel to the sliding direction of the sheet position limiting member, the second rib coming in contact with the first rib; and wherein the pair of the first rib and the second rib slide while coming in contact with each other.

The sheet position limiting member may be energized toward the guide member where the second rib functions as a fulcrum.

A sliding resistance giving member may be provided between a part of the sheet position limiting member energized toward the guide member and an energizing member.

The sheet position limiting member may be a side fence provided so that the sheet position limiting surface faces in a direction perpendicular to a sheet conveyance direction, the side fence being configured to limit the position of the sheet in the width direction.

The sheet position limiting member may be an end fence provided so that the sheet position limiting surface faces in the sheet conveyance direction.

According to another embodiment of the present invention, it is also possible to provide a sheet guide, including the sliding mechanism mentioned above, wherein two of the sheet position limiting members are provided at the guide member, one of the sheet position limiting members interlocks with the other sheet position limiting member, and a gap between the sheet position limiting members is variable.

Each of the sheet position limiting members may have a rack; and the racks are engaged with a common pinion so that the sheet position limiting members may be interlocked with each other and slide with the guide member.

A pair of the first rib and the second rib may be provided at an upper stream side in the sheet conveyance direction compared to a position where the racks and the pinion are engaged with each other.

Two pairs each pair including one of the first rib and one of the second rib may be provided; one pair may be provided at the upper stream side and the other pair is provided at a lower stream side in the sheet conveyance direction compared to the position where the racks and the pinion are engaged with each other.

According to the embodiment of the present invention, it is also possible to provide a sheet loading device, including a housing configured to receive sheets; and the sliding mechanism mentioned above.

According to the embodiment of the present invention, it is also possible to provide a sheet loading device including a housing configured to receive sheets; and the sheet guide mentioned above.

According to another embodiment of the present invention, it is also possible to provide a manual sheet feeding tray including the sliding mechanism mentioned above.

According to another embodiment of the present invention, it is also possible to provide a manual sheet feeding tray, including the sheet guide mentioned above.

According to another embodiment of the present invention, it is also possible to provide an image forming apparatus, including the sheet loading device mentioned above.

According to another embodiment of the present invention, it is also possible to provide an image forming apparatus, including the manual sheet feeding tray mentioned above.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

For example, a structure where the sheet feeding cassette and the manual sheet feeding tray are connected to each other is discussed in the above-discussed embodiment of the present invention. However, the present invention is not limited to this. It is not necessary to provide the sheet feeding cassette and the manual sheet feeding tray in a body.

In addition, a structure where both side fences are slid relative to each other is discussed in the above-discussed embodiment of the present invention. However, the present invention is not limited to this. Only one of the side fences may be movable, for example.

Furthermore, the present invention can be applied to an end fence (see FIG. 3) configured to come in contact with an end part, at a downstream side in the conveyance direction, of the sheet set in the paper feeding cassette so as to limit the position of the sheet in the conveyance direction.

In addition, the present invention can be applied to not only the side fence or the end fence but also a member slidably formed.

Thus, the present invention can be applied to various modifications.

This patent application is based on Japanese Priority Patent Application No. 2006-330552 filed on Dec. 7, 2006, the entire contents of which are hereby incorporated by reference.

What is claimed is:

1. A sliding mechanism provided in an image forming apparatus having a sheet feeding tray, comprising:

a sheet position limiting member provided at a front side of the sheet feeding tray, the sheet position limiting member having a sheet position limiting surface, the sheet position limiting member being configured to slide in a direction perpendicular to the plane of the sheet position limiting surface;

a guide member configured to guide the sliding of the sheet position limiting member; and an operational part provided at a front surface of the image forming apparatus, wherein the sheet position limiting member includes a wall including a limiting surface;

a bottom substantially parallel with a sheet; and a first rib provided at a surface of the bottom coming in contact with the guide member, the first rib being parallel to the sliding direction;

wherein the guide member includes a second rib and a third rib, the second rib forming a pair with the first rib, the second rib being situated in a direction substantially parallel to the sliding direction of the sheet position limiting member, the second rib coming in contact with the first rib, the second rib and the third rib configured to guide the sheet position limiting member, wherein the first rib, the second rib, and the third rib are provided inside the image forming apparatus;

wherein the first rib and the second rib slide while coming in contact with each other;

wherein the sheet position limiting member is energized toward the guide member;

wherein the operational part, the first rib, the second rib, and the third rib are arranged in this order from an upstream side of a sheet conveyance direction;

wherein the third rib, among the first rib, the second rib, and the third rib, is situated in a highest position;

wherein the second rib, among the first rib, the second rib, and the third rib, is situated in a second highest position; and wherein the first rib, among the first rib, the second rib, and the third rib, is situated in a third highest position.

2. The sliding mechanism as claimed in claim 1, wherein the sheet position limiting member is energized toward the guide member where the second rib functions as a fulcrum.

3. The sliding mechanism as claimed in claim 2, wherein a sliding resistance giving member is provided between a part of the sheet position limiting member energized toward the guide member and an energizing member.

4. The sliding mechanism as claimed in claim 1, wherein the sheet position limiting member is a side fence provided so that the sheet position limiting surface faces in a direction perpendicular to the sheet conveyance direction, the side fence being configured to limit the position of the sheet in the width direction.

5. The sliding mechanism as claimed in claim 1, wherein the sheet position limiting member is an end fence provided so that the sheet position limiting surface faces in the sheet conveyance direction.

6. A sheet guide, comprising: the sliding mechanism as claimed in claim 1, wherein two of the sheet position limiting members are provided at the guide member; and one of the sheet position limiting members interlocks with the other sheet position limiting member and a gap between the sheet position limiting members is variable.

7. The sheet guide as claimed in claim 6, wherein each of the sheet position limiting members has a rack; the racks are engaged with a common pinion so that the sheet position limiting members are interlocked with each other and slide with the guide member.

8. The sheet guide as claimed in claim 7, wherein a pair of the first rib and the second rib is provided at an upper stream side in the sheet conveyance direction compared to a position where the racks and the pinion are engaged with each other.

9. The sheet guide as claimed in claim 7, wherein two pairs each pair including one of the first rib and one of the second rib are provided; one pair is provided at the upper stream side and the other pair is provided at a lower stream side in the sheet conveyance direction compared to the position where the racks and the pinion are engaged with each other.

10. A sheet loading device, comprising: a housing configured to receive sheets; and the sliding mechanism as claimed in claim 4.

11. An image forming apparatus, comprising: the sheet loading device as claimed in claim 10.

12. A sliding mechanism provided in an image forming apparatus having a sheet feeding tray, comprising:

a sheet position limiting member having a sheet position limiting surface, the sheet position limiting member being configured to slide in a direction perpendicular to the plane of the sheet position limiting surface, the sheet position limiting member provided at a front side of a sheet feeding tray, the sheet position limiting member including a first rib; and a guide member configured to guide the sliding of the sheet position limiting member, the guide member having a second rib and a third rib, the second rib and the third rib configured to guide the sheet position limiting member; and an operational part provided at a front surface of the image forming apparatus, wherein the first rib, the second rib, and the third rib are provided inside the image forming apparatus;

wherein the first rib and the second rib slide while coming in contact with each other;

wherein a sliding resistance is formed between the sheet position limiting member and the second rib;

wherein the operational part, the first rib, the second rib, and the third rib are arranged in this order from an upstream side of a sheet conveyance direction;

wherein the third rib, among the first rib, the second rib, and the third rib, is situated in a highest position;

wherein the second rib, among the first rib, the second rib, and the third rib, is situated in a second highest position; and wherein the first rib, among the first rib, the second rib, and the third rib, is situated in a third highest position.

* * * * *